US010029300B2

(12) United States Patent
Olsen

(10) Patent No.: US 10,029,300 B2
(45) Date of Patent: Jul. 24, 2018

(54) VENTED BLANK FOR PRODUCING A MATRIX BIT BODY

(71) Applicant: Halliburton Energy Services, Inc., Houston, TX (US)

(72) Inventor: Garrett T. Olsen, The Woodlands, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 232 days.

(21) Appl. No.: 14/905,490

(22) PCT Filed: Dec. 10, 2013

(86) PCT No.: PCT/US2013/074001
§ 371 (c)(1),
(2) Date: Jan. 15, 2016

(87) PCT Pub. No.: WO2015/088488
PCT Pub. Date: Jun. 18, 2015

(65) Prior Publication Data

US 2016/0151831 A1 Jun. 2, 2016

(51) Int. Cl.

| | |
|---|---|
| ***B22D 19/14*** | (2006.01) |
| ***B22D 23/06*** | (2006.01) |
| ***B22D 25/02*** | (2006.01) |
| ***B22C 9/08*** | (2006.01) |
| ***B22C 9/10*** | (2006.01) |

(Continued)

(52) U.S. Cl.
CPC ..... *B22C 9/106* (2013.01); *B22C 9/08* (2013.01); *B22C 9/10* (2013.01); *B22C 9/24* (2013.01); *B22C 23/00* (2013.01); *B22D 19/14* (2013.01); *B22D 23/06* (2013.01); *B22D 25/02* (2013.01); *B22F 3/004* (2013.01); *B28B 1/16* (2013.01);

(Continued)

(58) Field of Classification Search
CPC .. B22C 9/08; B22C 9/10; B22C 9/106; B22C 9/22; B22C 9/24; B22D 19/02; B22D 19/14; B22D 23/06; B22D 25/02
USPC ..... 164/91, 97, 271, 332, 333, 334, 80, 302
See application file for complete search history.

(56) References Cited

U.S. PATENT DOCUMENTS

| | | | |
|---|---|---|---|
| 5,944,128 | A | 8/1999 | Truax et al. |
| 2008/0028891 | A1 | 2/2008 | Calnan et al. |

(Continued)

FOREIGN PATENT DOCUMENTS

| | | | |
|---|---|---|---|
| CN | 201416393 | Y | 3/2010 |
| CN | 101737011 | A | 6/2010 |

(Continued)

OTHER PUBLICATIONS

International Search Report and Written Opinion for PCT/US2013/074001 dated Sep. 29, 2014.

(Continued)

*Primary Examiner* — Kevin P Kerns
(74) *Attorney, Agent, or Firm* — McDermott Will & Emery LLP

(57) ABSTRACT

A vented blank may be useful in the production of a matrix bit body. A mold assembly for use in producing a matrix bit body may include a cavity defined within the mold assembly. A core and a matrix material are disposed within the cavity. A metal blank is disposed about the core and supported at least partially by the matrix material such that the metal blank extends above the matrix material. A vent extends from the metal blank, defining an annular space between the vent and the mold assembly.

20 Claims, 8 Drawing Sheets

(51) Int. Cl.

| | |
|---|---|
| ***B22C 9/24*** | (2006.01) |
| ***B22F 3/00*** | (2006.01) |
| ***C22C 1/10*** | (2006.01) |
| ***B22C 23/00*** | (2006.01) |
| ***B28B 1/16*** | (2006.01) |
| ***B28B 7/00*** | (2006.01) |
| *B22F 5/00* | (2006.01) |

(52) U.S. Cl.
CPC ..... *B28B 7/0008* (2013.01); *C22C 1/1036* (2013.01); *B22F 2005/001* (2013.01)

(56) References Cited

U.S. PATENT DOCUMENTS

| | | | |
|---|---|---|---|
| 2010/0101747 | A1 | 4/2010 | Tomczak et al. |
| 2010/0155148 | A1 | 6/2010 | Choe et al. |
| 2010/0192475 | A1 | 8/2010 | Stevens et al. |
| 2010/0278604 | A1 | 11/2010 | Glass et al. |
| 2011/0084420 | A1 | 4/2011 | Reese et al. |
| 2012/0298323 | A1 | 11/2012 | Thomas et al. |
| 2013/0140095 | A1 | 6/2013 | Miller |

FOREIGN PATENT DOCUMENTS

| | | | |
|---|---|---|---|
| CN | 102513540 | A | 6/2012 |
| CN | 202684089 | U | 1/2013 |
| GB | 2318994 | A | 5/1998 |
| WO | 2010078129 | A2 | 7/2010 |
| WO | 2015088488 | A1 | 6/2015 |

OTHER PUBLICATIONS

Canadian Office Action from Canadian Patent Application No. 2,928,637, dated Mar. 27, 2017, 4 pages.

Chinese Office Action from Chinese Patent Application No. 201380080539.6, dated Mar. 10, 2017, 16 pages.

VENTED BLANK FOR PRODUCING A MATRIX BIT BODY

BACKGROUND

The present disclosure relates to a vented blank useful in the production or manufacturing of a matrix bit body.

Rotary drill bits are frequently used to drill oil and gas wells, geothermal wells and water wells. Rotary drill bits may be generally classified as roller cone drill bits or fixed cutter drill bits. Fixed cutter drill bits are often formed with a matrix bit body having cutting elements or inserts disposed at select locations about the exterior of the matrix bit body. During drilling, these cutting elements engage and remove adjacent portions of the subterranean formation.

The composite materials used to form the matrix bit body are generally erosion-resistant and have high impact strengths. However, defects in the composite materials formed during manufacturing of the matrix bit body can reduce the lifetime of the drill bit.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure relates to a vented blank useful in the production or manufacturing of a matrix bit body.

In one method of molding a matrix bit body, a liquefied binder is combined with a matrix material. The matrix material is typically in a particulate form (e.g., a powder). (Examples of suitable matrix and binder materials are listed further below.) As the liquefied binder is combined with the matrix material, the binder infiltrates the interstitial spaces of the matrix material. In some instances, depending on the size of the particles of the matrix material, the interstitial space can be about 30% by volume. The high volume percent of interstitial space provides ample opportunity for air to become trapped by the liquefied binder and could result in a matrix bit body that exhibits undesirable amounts of porosity. Such porosity would lower the overall strength of the composite, and could provide initiation or nucleation points for cracks in the matrix bit body. However, by applying the teachings of this disclosure, this can be reduced or avoided entirely. The flow paths created by the vented blanks described herein allow the liquefied binder material to displace trapped air, along with other trapped substances such as volatile chemicals, through the matrix material to the vent. By actively moving the air and other trapped substances through the matrix material in this manner, the porosity of the matrix bit body may be reduced, thereby increasing the strength and useful life of the matrix drill bit.

Figure 1:
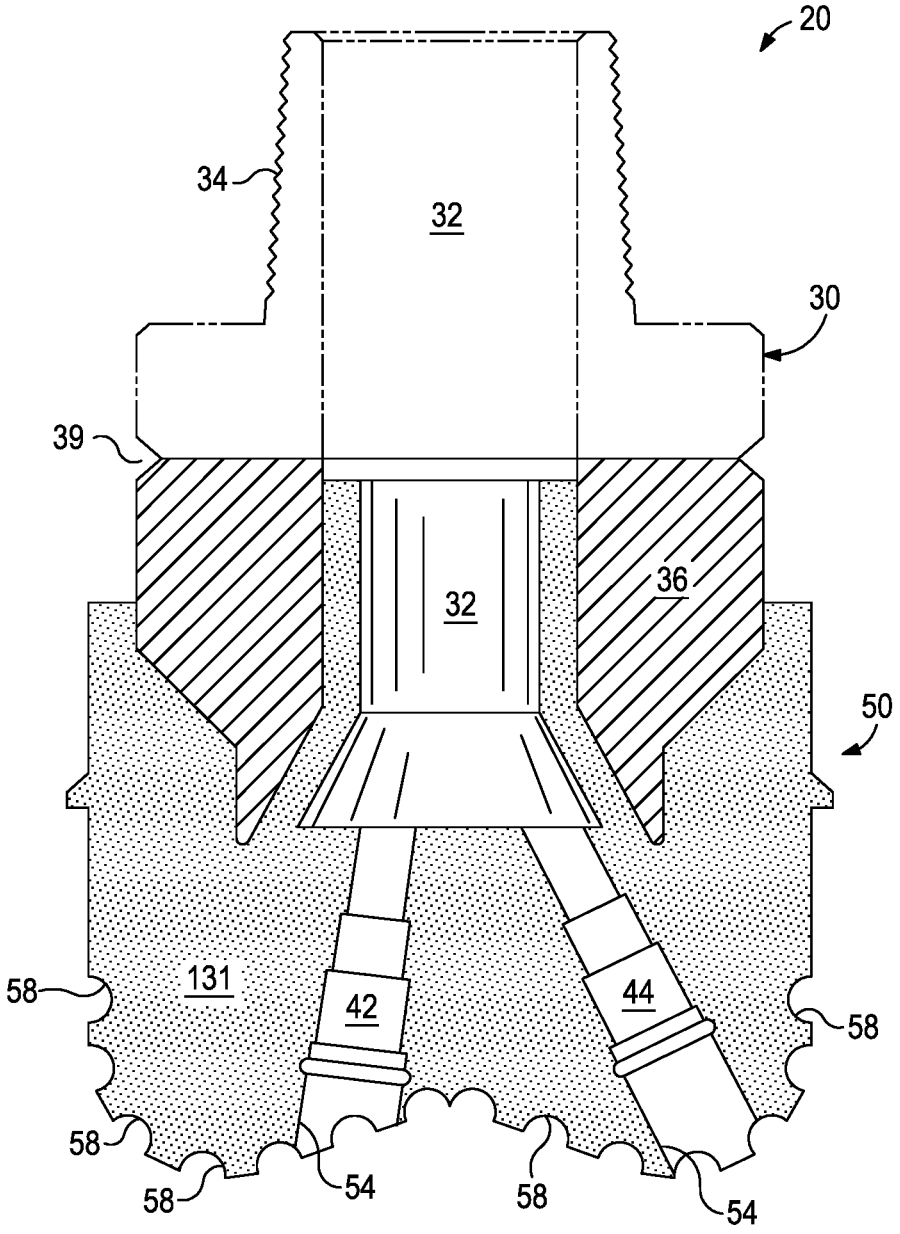
FIG. 1 is a cross-sectional view showing one example of a matrix drill bit in accordance with the teachings of the present disclosure.

FIG. 1 is a cross-sectional view of a matrix drill bit 20 formed with a matrix bit body 50 that comprises a hard composite material 131 in accordance with the teachings of the present disclosure. As used herein, the term "matrix drill bit" encompasses rotary drag bits, drag bits, fixed cutter drill bits, and any other drill bit capable of incorporating the teachings of the present disclosure.

For embodiments such as shown in FIG. 1, the matrix drill bit 20 may include a metal shank 30 with a metal blank 36 securely attached thereto (e.g., at weld location 39). The metal blank 36 extends into matrix bit body 50. The metal shank 30 comprises a threaded connection 34 distal to the metal blank 36.

The metal shank 30 and metal blank 36 are generally cylindrical structures that at least partially define corresponding fluid cavities 32 that fluidly communicate with each other. The fluid cavity 32 of the metal blank 36 may further extend longitudinally into the matrix bit body 50. At least one flow passageway (shown as two flow passageways 42 and 44) may extend from the fluid cavity 32 to exterior portions of the matrix bit body 50. Nozzle openings 54 may be defined at the ends of the flow passageways 42 and 44 at the exterior portions of the matrix bit body 50.

Figure 2:
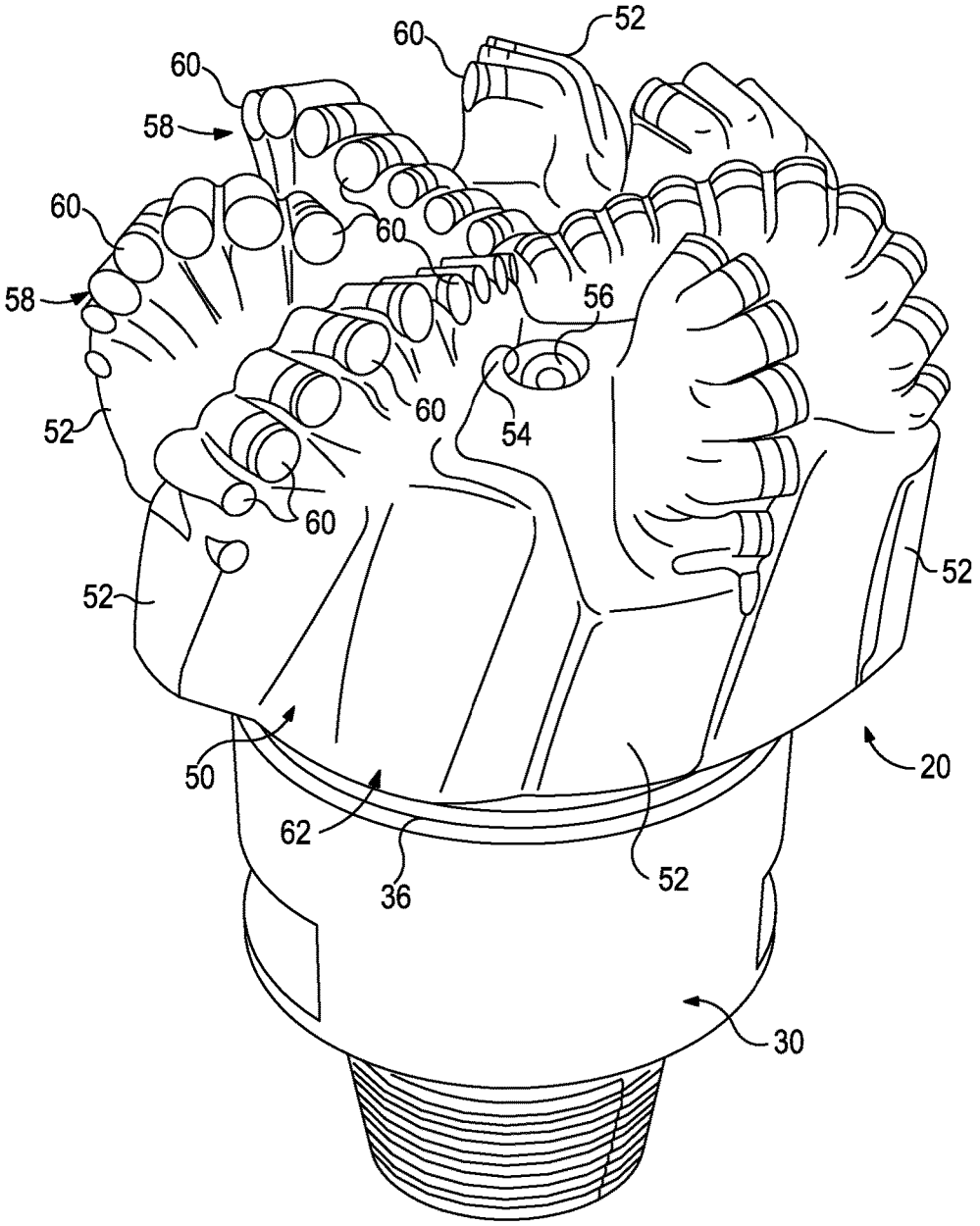
FIG. 2 is an isometric view showing one example of a matrix drill bit in accordance with the teachings of the present disclosure.

A plurality of indentations or pockets 58 are formed in the matrix bit body 50 and are shaped or otherwise configured to receive cutting elements (shown in FIG. 2).

FIG. 2 is an isometric view of the matrix drill bit 20 formed with the matrix bit body 50 that comprises a hard composite material in accordance with the teachings of the present disclosure. As illustrated, the matrix drill bit 20 includes the metal blank 36 and the metal shank 30, as generally described above with reference to FIG. 1.

The matrix bit body 50 includes a plurality of cutter blades 52 formed on the exterior of the matrix bit body 50. Cutter blades 52 may be spaced from each other on the exterior of the matrix bit body 50 to form fluid flow paths or junk slots 62 therebetween.

As illustrated, the plurality of pockets 58 may be formed in the cutter blades 52 at selected locations. A cutting element 60 (also known as a cutting insert) may be securely mounted (e.g., via brazing) in each pocket 58 to engage and remove portions of a subterranean formation during drilling operations. More particularly, the cutting elements 60 may scrape and gouge formation materials from the bottom and sides of a wellbore during rotation of the matrix drill bit 20 by an attached drill string. For some applications, various types of polycrystalline diamond compact (PDC) cutters may be used as cutting elements 60. A matrix drill bit having such PDC cutters may sometimes be referred to as a "PDC bit".

A nozzle 56 may be disposed in each nozzle opening 54. For some applications, nozzles 56 may be described or otherwise characterized as "interchangeable" nozzles.

Figure 3:
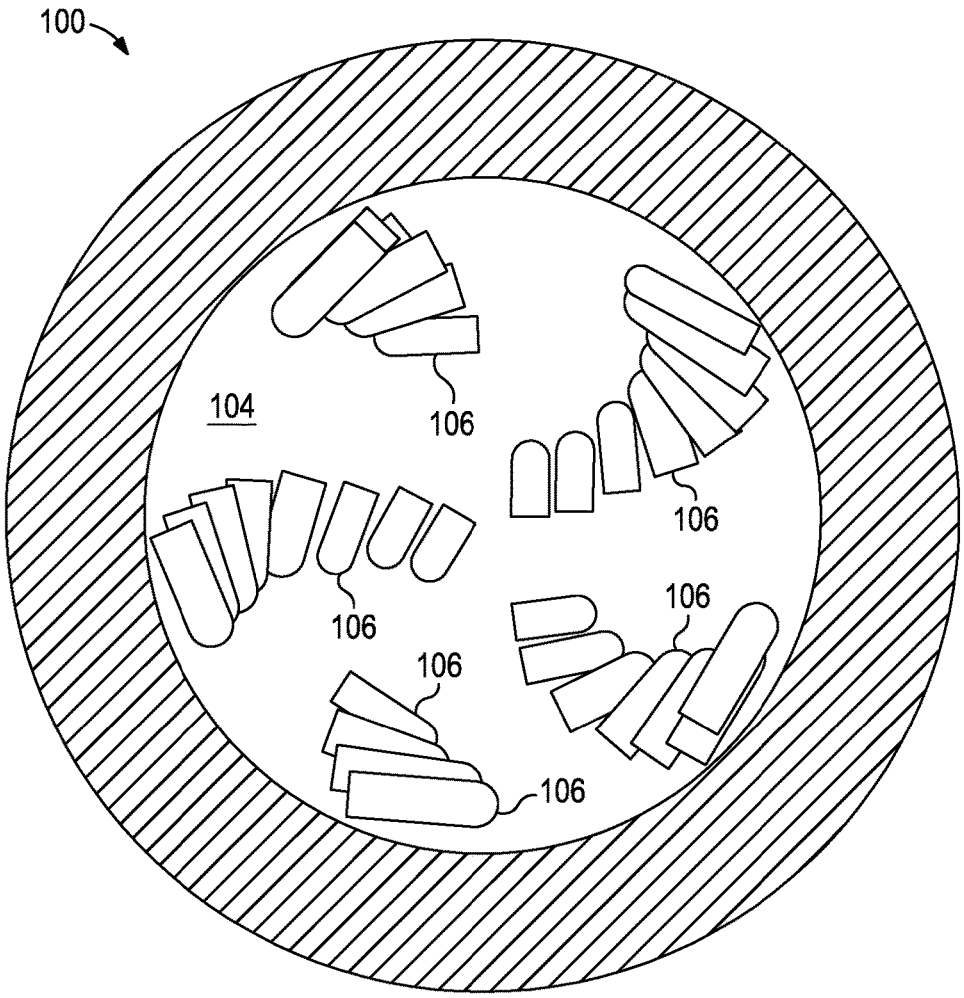
FIG. 3 is an end view showing one example of a mold assembly for use in forming a matrix bit body in accordance with the teachings of the present disclosure.

FIG. 3 is an end view showing one example of a mold assembly 100 for use in forming a matrix bit body incorporating teachings of the present disclosure. A plurality of mold inserts 106 may be placed within the cavity 104 of the mold assembly 100 to form the respective pockets in each blade of the matrix bit body. The location of mold inserts 106 in cavity 104 corresponds with desired locations for installing the cutting elements in the associated blades. Mold inserts 106 may be formed from various types of material such as, but not limited to, consolidated sand and graphite.

Various types of temporary materials may be installed within mold cavity 104, depending upon the desired configuration of a resulting matrix drill bit. Additional mold inserts (not expressly shown) may be formed from various materials such as consolidated sand and/or graphite may be disposed within mold cavity 104. Such mold inserts may have configurations corresponding to the desired exterior features of the matrix drill bit (e.g., junk slots).

Figure 4:
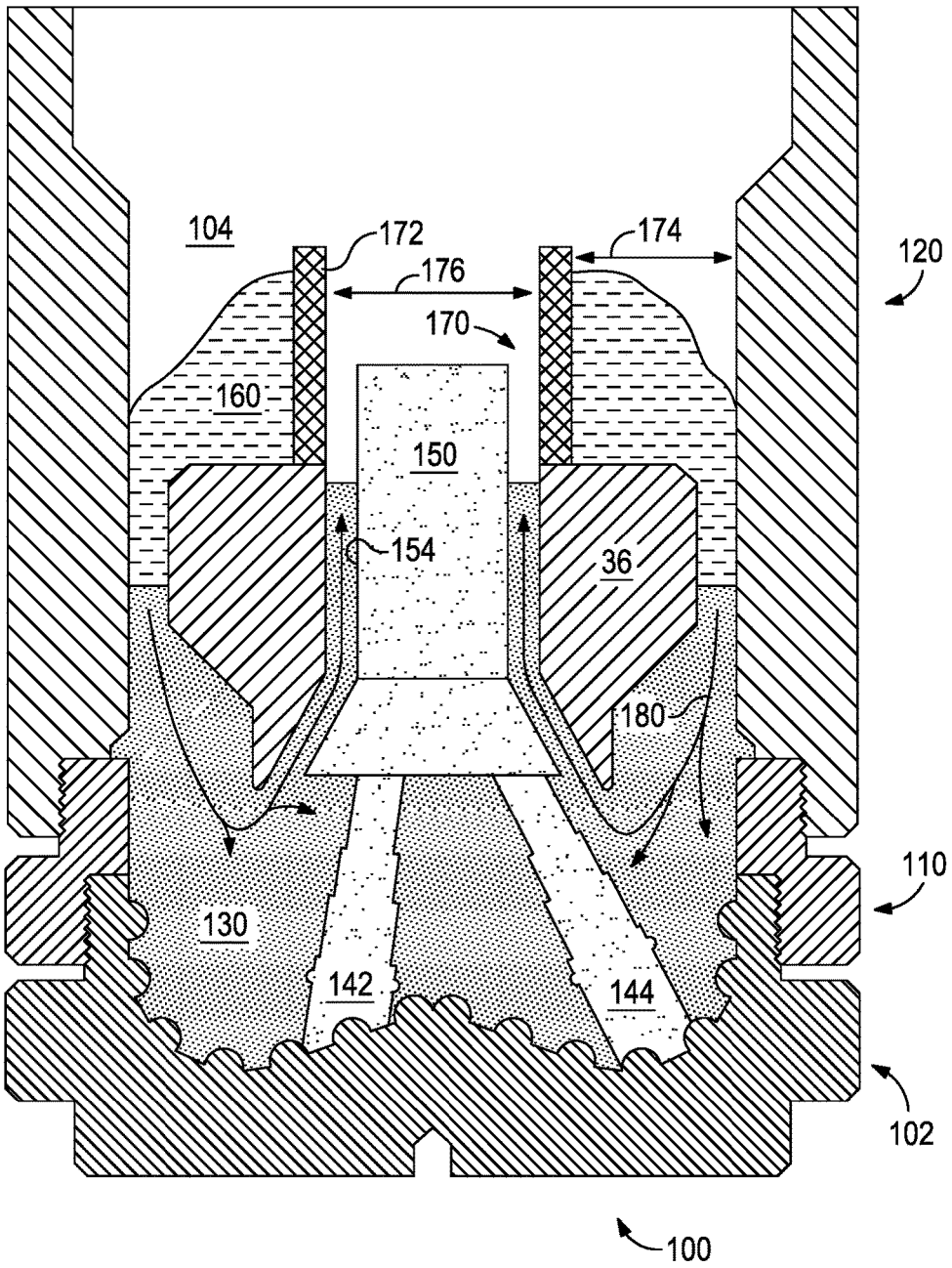
FIG. 4 is a cross-sectional view showing of the mold assembly of FIG. 3 for use in forming a matrix bit body in accordance with the teachings of the present disclosure.

FIG. 4 is a cross-sectional view of the mold assembly 100 of FIG. 3 that may be used in forming a matrix bit body incorporating the teachings of the present disclosure. A wide variety of molds may be used to form a matrix bit body in accordance with the teachings of the present disclosure.

The mold assembly 100 may include several components such as a mold 102, a gauge ring or connector ring 110, and a funnel 120. Mold 102, gauge ring 110, and funnel 120 may be formed from graphite, for example, or other suitable materials known to those skilled in the art. A cavity 104 may be defined or otherwise provided within the mold assembly 100. Various techniques may be used to manufacture the mold assembly 100 and components thereof including, but not limited to, machining a graphite blank to produce the mold 102 with the associated cavity 104 having a negative profile or a reverse profile of desired exterior features for a resulting matrix bit body. For example, the cavity 104 may have a negative profile that corresponds with the exterior profile or configuration of the blades 52 and the junk slots 62 formed therebetween, as shown in FIGS. 1-2.

Referring still to FIG. 4, materials (e.g., consolidated sand) may be installed within mold assembly 100 at desired locations to form the desired exterior features of the matrix drill bit (e.g., the fluid cavity and the flow passageways). Such materials may have various configurations. For example, the orientation and configuration of the consolidated sand legs 142 and 144 may be selected to correspond with desired locations and configurations of associated flow passageways and their respective nozzle openings. The consolidated sand legs 142 and 144 may be coupled to threaded receptacles (not expressly shown) for forming the threads of the nozzle openings that couple the respective nozzles thereto.

A relatively large, generally cylindrically-shaped consolidated sand core 150 may be placed on the legs 142 and 144. Core 150 and legs 142 and 144 may be sometimes described as having the shape of a "crow's foot," and core 150 may be referred to as a "stalk." The number of legs 142 and 144 extending from core 150 will depend upon the desired number of flow passageways and corresponding nozzle openings in a resulting matrix bit body. The legs 142 and 144 and the core 150 may also be formed from graphite or other suitable materials.

After desired materials, including core 150 and legs 142 and 144, have been installed within mold assembly 100, the matrix material 130 may then be placed within or otherwise introduced into the mold assembly 100. After a sufficient volume of the matrix material 130 has been added to the mold assembly 100, a vented blank 170 may then be placed within mold assembly 100. The amount of matrix material 130 added to the mold assembly 100 before addition of the vented blank 170 depends on the configuration of the vented blank 170 and the desired configuration of the vented blank 170 within the mold assembly 100. Typically, the vented blank 170 is supported at least partially by the matrix material.

As illustrated, the vented blank 170 may include the metal blank 36 and a vent 172 coupled to and otherwise extending from the metal blank 36, thereby defining an interior space 176. An annular space 174 is defined between the vent 172 and the mold assembly 100.

The diameter of the interior space 176 of the vented blank 170 is preferably larger than the outside diameter 154 of the sand core 150. Various fixtures or supports (not expressly shown) may be used to position the vented blank 170 within the cavity 104 at a desired location. Then, additional matrix material 130 may be added to a desired level within the cavity 104.

Binder material 160 may be placed on top of the matrix material 130 and metal blank 36 within the annular space 174. In some embodiments, the binder material 160 may be covered with a flux layer (not expressly shown). The amount of binder material 160 and optional flux material added to the annular space 174 should be at least enough to infiltrate the matrix material 130 during the infiltration process. In some instances, excess binder material 160 may be used, which after infiltration may be removed by machining.

A cover or lid (not expressly shown) may be placed over the mold assembly 100. The mold assembly 100 and materials disposed therein may then be preheated and then placed in a furnace. When the furnace temperature reaches the melting point of the binder material 160, the binder material 160 liquefies and the liquefied binder material 160 may proceed to infiltrate the matrix material 130 along a flow path indicated by the arrows 180. The flow path 180 starts at the matrix material 130 in the annular space 174 and continues through the bulk of the matrix material 130, eventually infiltrating the matrix material 130 disposed between the core 150 and the vented blank 170. The flow of the liquefied binder material 160 along the flow path 180 moves air and any volatile chemicals or other materials trapped within the interstices through the matrix material 130 during infiltration. Additional forces may be applied to facilitate the flow of the liquefied binder material 160 and corresponding movement of air and volatile chemicals through the matrix material 130, such as by varying the air pressure in the interior space 176, the annular space 174, or both (described in more detail herein). The interior space 176 of the vented blank 170 provides a location where the air and other volatile chemicals can escape the matrix material 130 without becoming entrapped in the liquefied binder material 160.

Generally, the vent 172 should extend from the metal blank 36 a sufficient amount such that the liquefied binder material 160 does not flow over the top of the vent 172 and into the interior space 176. Further, the coupling of the metal blank 36 and vent 172 should be configured to withstand temperatures of the furnace such that the liquefied binder material 160 does not pass directly from the annular space 174 to the interior space 176. Examples of couplings may include, but are not limited to, threading, welding, brazing, mechanical fasteners, press fitting, adhesives, high temperature sealing devices, combinations thereof, and the like. In some embodiments, the vent 172 may form an integral part of the metal blank 36 and otherwise extend longitudinally therefrom (not shown). The vent 172 may be formed of any suitable material that can sufficiently withstand the temperatures of the furnace (e.g., graphite, steel, titanium, ceramics, carbides, and the like).

After a predetermined amount of time allotted for the liquefied binder material 160 to infiltrate matrix material 130, the mold assembly 100 may then be removed from the furnace and cooled at a controlled rate. Once cooled, the mold assembly 100 may be broken away to expose the matrix bit body that comprises the hard composite material. Further, the vent 172 may be decoupled from the metal blank 36. Subsequent processing according to well-known techniques may be used to produce a matrix drill bit that comprises the matrix bit body.

One of skill in the art will readily recognize that the principles described herein are equally applicable to other configurations of the mold assembly 100 and the vented blank 170.

Figure 5:
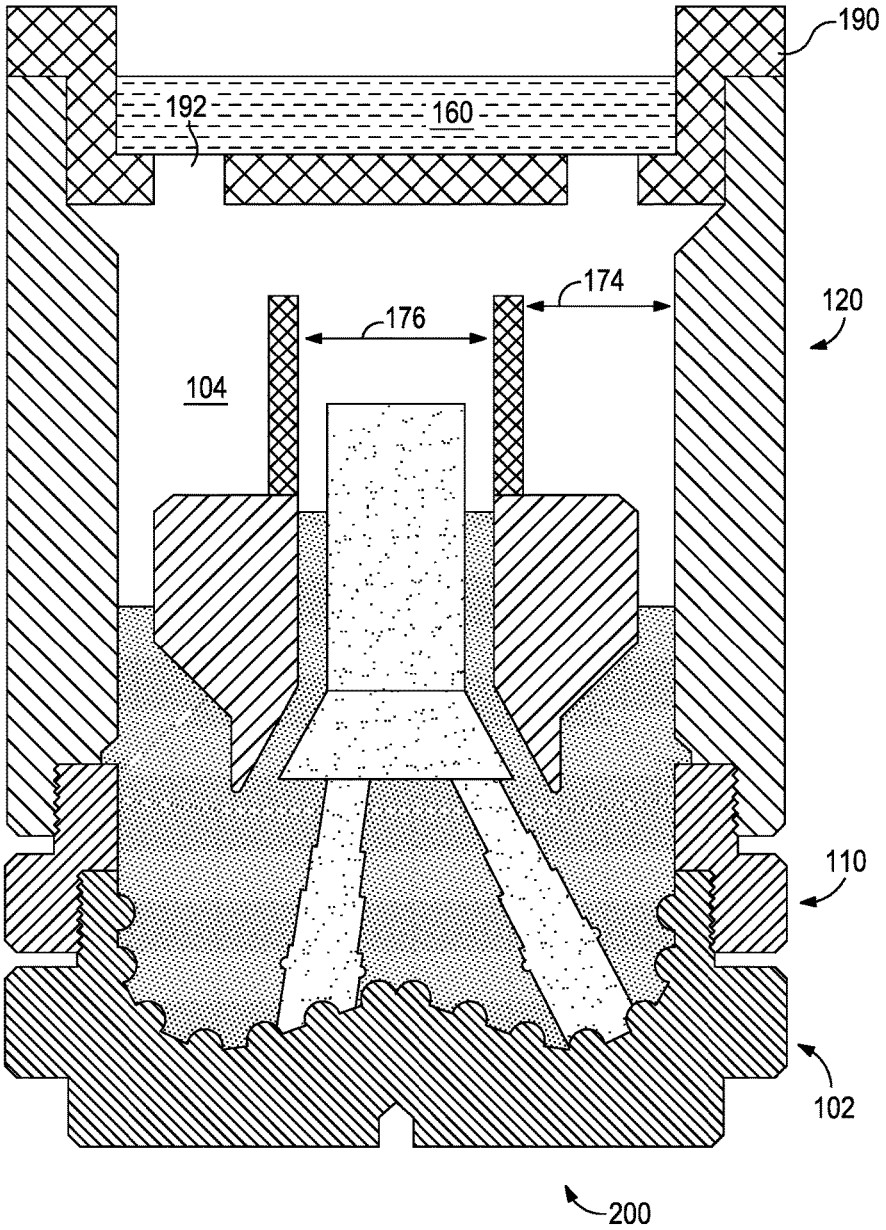
FIG. 5 is a cross-sectional view showing one example of a mold assembly for use in forming a matrix bit body in accordance with the teachings of the present disclosure.

FIG. 5 is a cross-sectional view showing one example of a mold assembly 200 that may be used in forming a matrix bit body incorporating teachings of the present disclosure. The mold assembly 200 may include several components such as a mold 102, a gauge ring 110, and a funnel 120 as described in FIG. 1 and may further include a binder bowl 190 coupled thereto (e.g., resting in or mechanical fastened to the funnel 120 distal to the mold 102 and the gauge ring 110). The binder material 160 may be disposed within the binder bowl 190 and, when liquefied, pass through passageways 192 defined in the binder bowl 190 and into the cavity 104 disposed therebelow. The binder bowl 190 may be configured with the passageways 192 disposed above the annular space 174 such that any liquefied binder material 160 passing through the passageways 192 is conveyed to the annular space 174 and otherwise generally prevented from entering the interior space 176.

In alternate embodiments (not shown), the vent 172 may extend to or at least partially through the binder bowl 190. This may advantageously mitigate the possibility that the liquefied binder material 160 inadvertently flows into the interior space 176.

Figure 6:
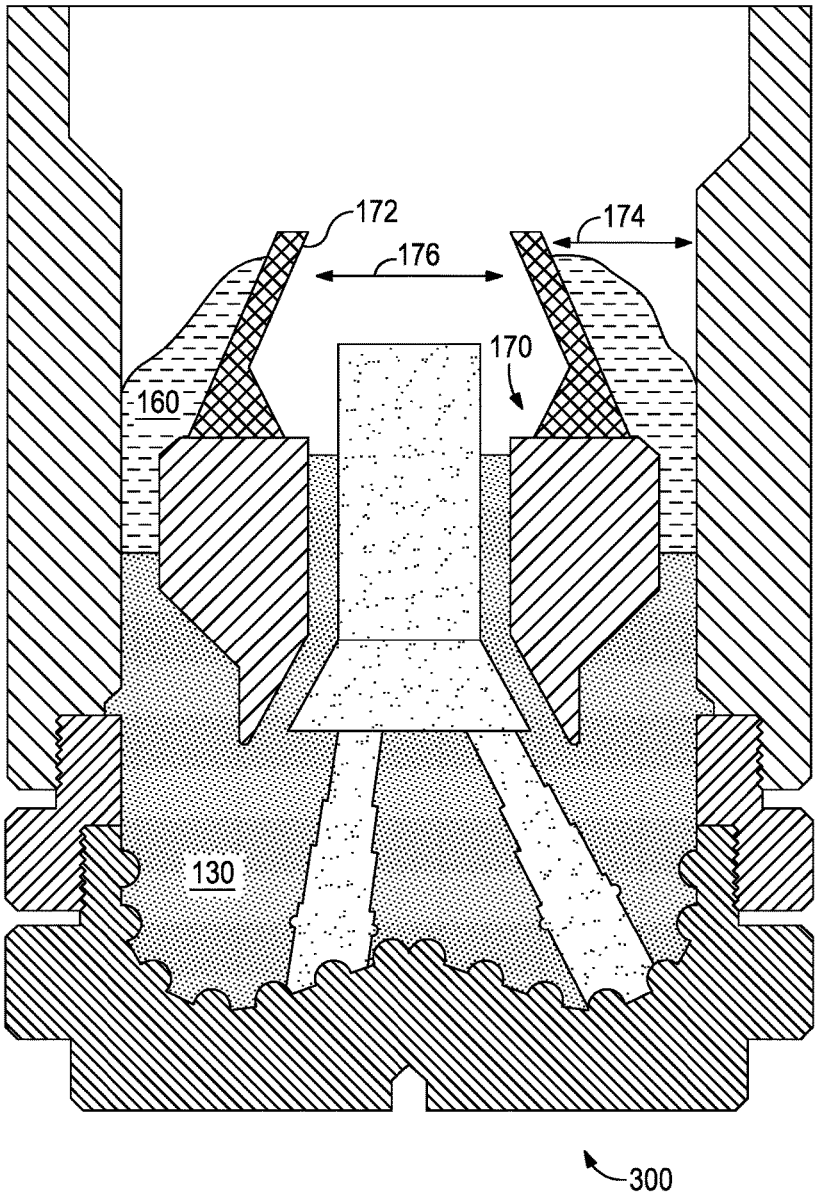
FIG. 6 is a cross-sectional view showing one example of a mold assembly for use in forming a matrix bit body in accordance with the teachings of the present disclosure.

FIG. 6 is a cross-sectional view showing one example of a mold assembly 300 that may be used in forming a matrix bit body incorporating teachings of the present disclosure. The mold assembly 300 of FIG. 6 may be similar to that of FIG. 4 except that the vent 172 has a frustoconical shape, where its outer walls taper outward or progressively taper outward toward the bottom of the mold assembly 300. In some instances, the frustoconical shape may be arcuate frustoconical (not shown). As used herein, the term "arcuate frustoconical" refers to a frustoconical structure having a concave and/or convex exterior wall. As will be appreciated, the frustoconical shape of the vent 172 shown in FIG. 6 may assist with funneling liquefied binder 160 into the annular space 174 so that it may interact with the matrix material 130. This may be particularly useful in embodiments that combine a frustoconically-shaped vent 172 and a binder bowl 190, as generally described in FIG. 5.

In some embodiments, the removal of the air and other volatile chemicals from the interstices of the matrix material 130 may be enhanced by reducing the air pressure within the interior space 176 as compared to the annular space 174, and thereby drawing the air into the interior space 176. This pressure differential may be achieved by fluidly coupling the interior space 176 to a low pressure source (not shown), such as through the use of pneumatic piping or the like. In other embodiments, the pressure differential may generally be achieved by reducing the air pressure in the interior space 176 and otherwise increasing the air pressure on the liquefied binder material 160. In some instances, the interior space 176 and the annular space 174 may be fluidly coupled only through the interstitial spaces of the matrix material 130.

Figure 7:
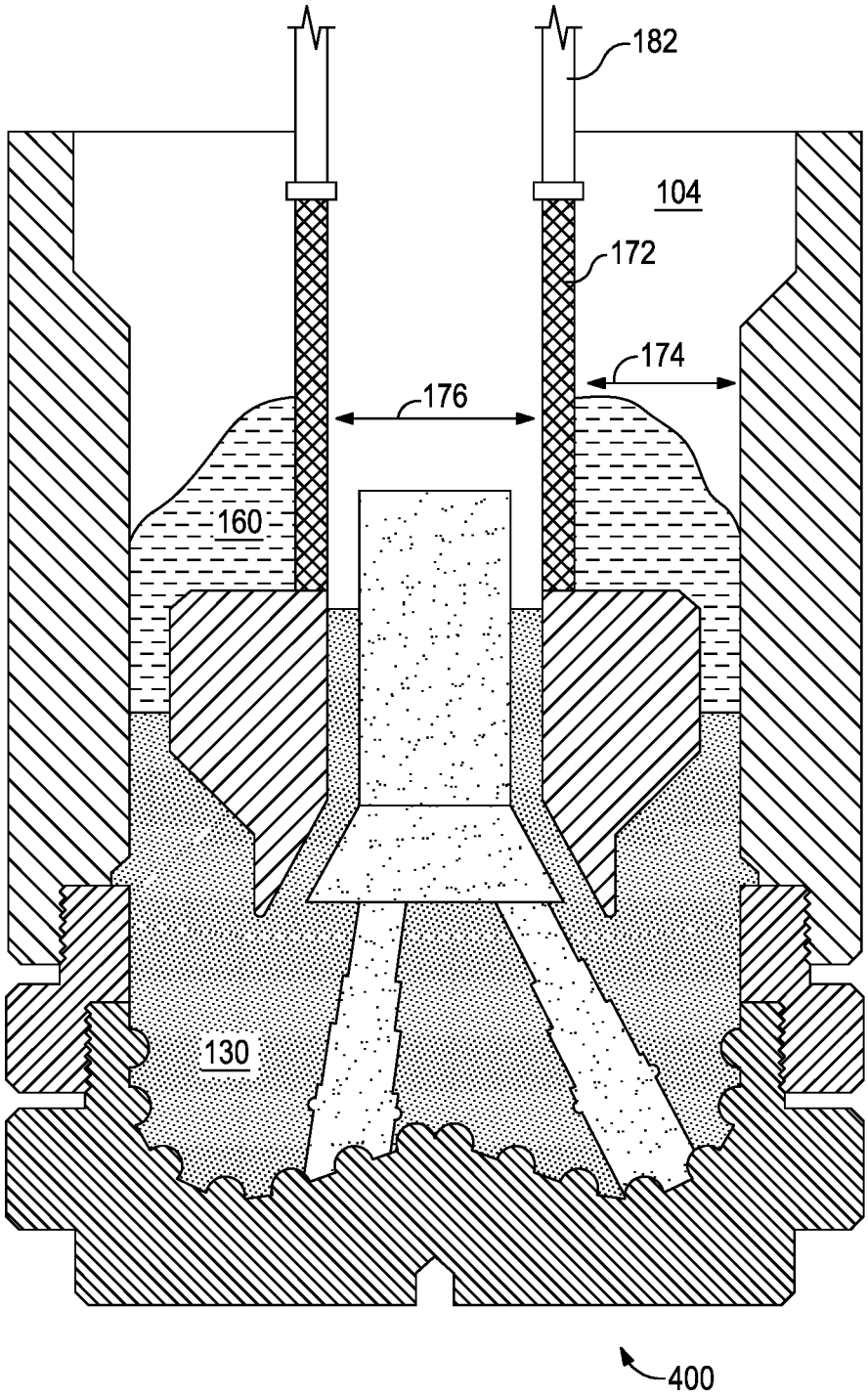
FIG. 7 is a cross-sectional view showing one example of a mold assembly for use in forming a matrix bit body in accordance with the teachings of the present disclosure.

FIG. 7 is a cross-sectional view showing one example of a mold assembly 400 that may be used in forming a matrix bit body incorporating teachings of the present disclosure. The mold assembly 400 of FIG. 7 may be similar to that of FIG. 4 except that the vent 172 is fluidly and operatively coupled to a tubing 182 that extends out of the cavity 104. The tubing 182 further isolates the interior space 176 from the annular space 174 and allows for the air pressure in the interior space 176 to be reduced. For instance, the tubing 182 may be fluidly coupled at its opposite end to a low pressure source, such as a vacuum or the like. Reduction in air pressure in the interior space 176 may reduce the amount of air and other volatile chemicals in the interstitial spaces of the matrix material 130 and further mitigate the formation of the undesirable air pockets as the liquefied binder 160 infiltrates the matrix material 130.

Similarly, in some embodiments, a mold assembly may further comprises a tubing or other mechanism (not shown) to seal the annular space 174 and allow the air pressure to be increased therein. Combinations of the foregoing are also acceptable in some embodiments.

Not all features of a physical implementation are described or shown in this application for the sake of clarity. For example, a thermocouple may be inserted into the core 150 to monitor the temperature during infiltration. Accordingly, depending on the embodiment, the vent 172, the tubing 182 coupled thereto, the binder bowl 190, and the like may be modified to accommodate the thermocouple.

It is understood that in the development of a physical embodiment incorporating the embodiments of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill the art and having benefit of this disclosure.

Further, one of skill in the art will recognize the appropriate the matrix material and the binder material relative to the desired mechanical properties of the matrix drill bit. Examples of matrix materials suitable for use in conjunction with the embodiments described herein may include, but are not limited to, particles or powders of metals, metal alloys, metal carbides (e.g., tungsten carbides, macrocrystalline tungsten carbides, cast tungsten carbides, crushed sintered tungsten carbides, and carburized tungsten carbides), metal nitrides, diamonds, superalloys, and the like, or any combination thereof. Examples of binders suitable for use in conjunction with the embodiments described herein may include, but are not limited to, copper, nickel, cobalt, iron, aluminum, molybdenum, chromium, manganese, tin, zinc, lead, silicon, tungsten, boron, phosphorous, gold, silver, palladium, indium, any mixture thereof, any alloy thereof, and any combination thereof. Nonlimiting examples of binders may include copper-phosphorus, copper-phosphorous-silver, copper-manganese-phosphorous, copper-nickel, copper-manganese-nickel, copper-manganese-zinc, copper-manganese-nickel-zinc, copper-nickel-indium, copper-tin-manganese-nickel, copper-tin-manganese-nickel-iron, gold-nickel, gold-palladium-nickel, gold-copper-nickel, silver-copper-zinc-nickel, silver-manganese, silver-copper-zinc-cadmium, silver-copper-tin, cobalt-silicon-chromium-nickel-tungsten, cobalt-silicon-chromium-nickel-tungsten-boron, manganese-nickel-cobalt-boron, nickel-silicon-chromium, nickel-chromium-silicon-manganese, nickel-chromium-silicon, nickel-silicon-boron, nickel-silicon-chromium-boron-iron, nickel-phosphorus, nickel-manganese, copper-aluminum, copper-aluminum-nickel, copper-aluminum-nickel-iron, copper-aluminum-nickel-zinc-tin-iron, and the like, and any combination thereof.

Figure 8:
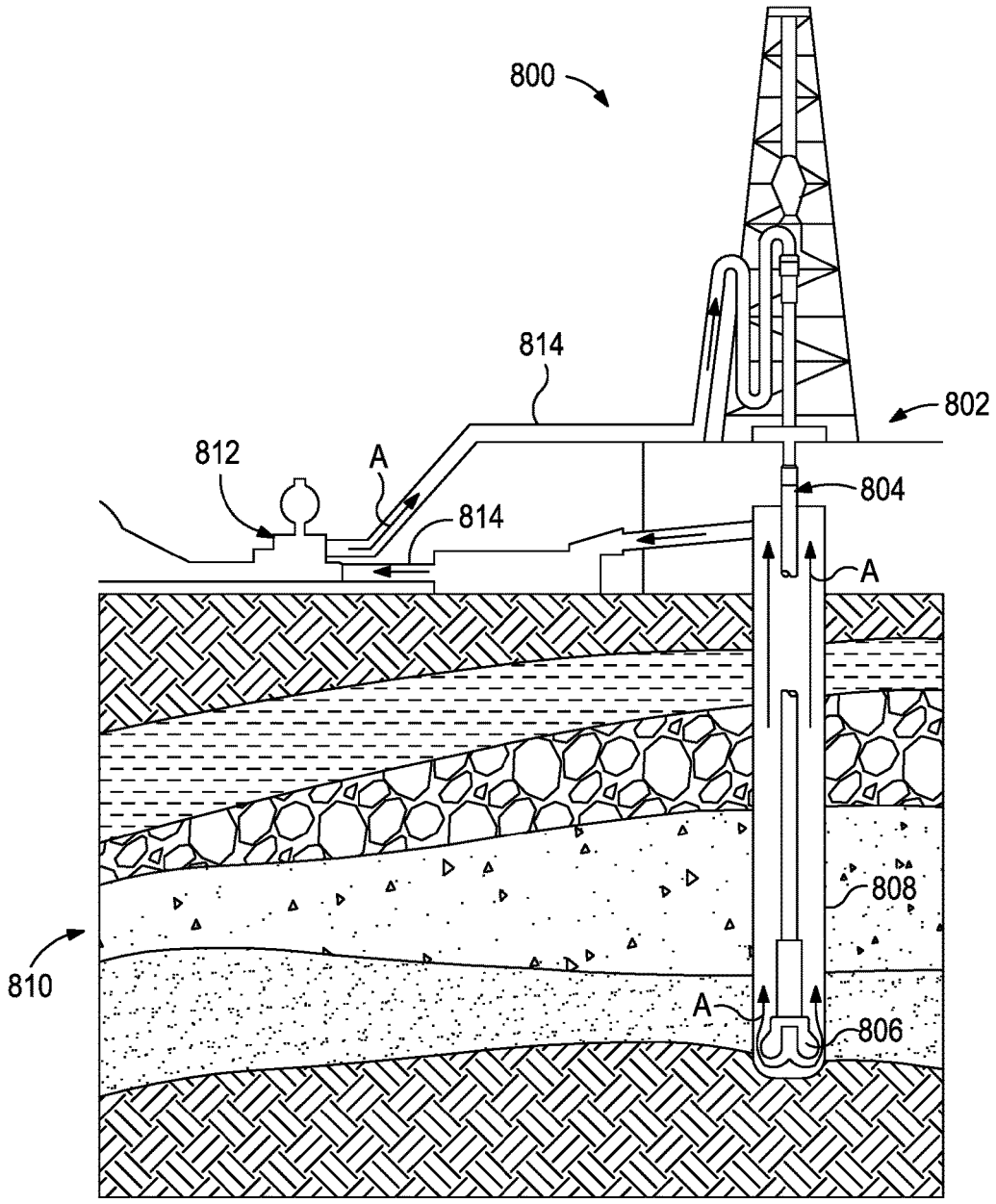
FIG. 8 is a schematic of a drilling assembly suitable for using the matrix drill bits in accordance with the teachings of the present disclosure.

FIG. 8 is a schematic of a drilling assembly 800 suitable for use in conjunction with the matrix drill bits described herein. It should be noted that while FIG. 8 generally depicts a land-based drilling assembly, those skilled in the art will readily recognize that the principles described herein are equally applicable to subsea drilling operations that employ floating or sea-based platforms and rigs, without departing from the scope of the disclosure.

The drilling assembly 800 includes a drilling platform 802 coupled to a drill string 804. The drill string 804 may include, but is not limited to, drill pipe and coiled tubing, as generally known to those skilled in the art. A matrix drill bit 806 according to the embodiments described herein is attached to the distal end of the drill string 804 and is driven either by a downhole motor and/or via rotation of the drill string 804 from the well surface. As the drill bit 806 rotates, it creates a wellbore 808 that penetrates the subterranean formation 810. The drilling assembly 800 also includes a pump 812 that circulates a drilling fluid through the drill string (as illustrated as flow arrows A) and other pipes 814.

One skilled in the art would recognize the other equipment suitable for use in conjunction with drilling assembly 800, which may include, but are not limited to, retention pits, mixers, shakers (e.g., shale shaker), centrifuges, hydrocyclones, separators (including magnetic and electrical separators), desilters, desanders, filters (e.g., diatomaceous earth filters), heat exchangers, and any fluid reclamation equipment. Further, the drilling assembly may include one or more sensors, gauges, pumps, compressors, and the like.

Some embodiments may involve implementing a matrix drill bit described herein in a drilling operation. For example, some embodiments may further involve drilling a portion of a wellbore with a matrix drill bit described herein.

Embodiments disclosed herein include a mold assembly that includes a cavity defined within the mold assembly; a core disposed within the cavity; a matrix material disposed within the cavity; a metal blank disposed about the core and supported at least partially by the matrix material such that the metal blank extends above the matrix material; and a vent extending from the metal blank and thereby defining an annular space between the vent and the mold assembly. Some embodiments may further include at least one of the following elements in any combination: Element 1: wherein the vent is coupled to the metal blank; Element 2: wherein the mold assembly further comprises a binder bowl coupled to the mold assembly and comprising at least one passageway disposed above the annular space; Element 3: Element 2 wherein the vent extends at least partially through the binder bowl; Element 4: wherein the mold assembly further comprises a tubing coupled to and extending from the vent, and wherein the tubing is operably connected to a low pressure source; Element 5: wherein the mold assembly further comprises a tubing coupled to the annular space; Element 6: wherein the vent is fluidly coupled to the annular space only through interstitial spaces of the matrix material; and Element 7: wherein the vent is frustoconical in shape.

By way of non-limiting example, exemplary combinations may include: Element 7 in combination with Element 2 and optionally Element 3; Element 4 in combination with Element 2 and optionally Element 3; Element 5 in combination with Element 2 and optionally Element 3; Element 6 in combination with Element 2 and optionally Element 3; Element 4 in combination with Element 7; Element 4 in combination with Element 6 and optionally Element 5; Element 4 in combination with Element 5; Element 5 in combination with Element 6; Element 1 in combination with any of the foregoing; and Element 1 in combination with one of Elements 2-7.

Additional embodiments described herein include:

A. a method that includes assembling a mold assembly that comprises: a cavity defined within the mold assembly; a core disposed within the cavity; a matrix material disposed within the cavity; a metal blank disposed about the core and supported at least partially by the matrix material such that the metal blank extends above the matrix material; and a vent coupled to and extending from the metal blank and thereby defining an annular space between the vent and the mold assembly; placing a binder material in the annular space; liquefying the binder material to produce a liquefied binder material; liquefying the binder material; and infiltrating the matrix material with the liquefied binder material to displace air from interstitial spaces of the matrix material to the vent; and B. a method that includes assembling a mold assembly that comprises: a cavity defined within the mold assembly; a core disposed within the cavity; matrix material disposed within the cavity; a metal blank disposed about the core and supported at least partially by the matrix material such that the metal blank extends above the matrix material; a vent coupled to and extending from the metal blank and thereby defining an annular space between the vent and the mold assembly; and a binder bowl coupled to the mold assembly and comprising at least one passageway disposed above the annular space; placing a binder material in the binder bowl; liquefying the binder material to produce a liquefied binder material; liquefying the binder material; and infiltrating the matrix material with the liquefied binder material to displace air from interstitial spaces of the matrix material to the vent.

Each of embodiments A and B may have one or more of the following additional elements in any combination: Element 8: wherein assembling the mold assembly involves placing a core within a cavity of a mold assembly; disposing a matrix material in the cavity; and supporting a metal blank about the core at least partially with the matrix material such that the metal blank extends above the matrix material, the metal blank having a vent extending therefrom and thereby defining an annular space between the vent and the mold assembly; Element 9: Element 8 further including coupling the vent to the metal blank; Element 10: wherein an air pressure in an interior space of the vent is less than an air pressure in the annular space; Element 11: the method further including coupling a tubing to the vent, the tubing being in fluid communication with a low pressure source; and reducing an air pressure within the interior space via the tubing; Element 12: the method further including coupling a tubing to the annular space, the tubing being in fluid communication with a high pressure source; and increasing an air pressure within the annular space via the tubing; Element 13: fluidly coupling the vent with the annular space only through the interstitial spaces of the matrix material;

Element 14: wherein the vent has a frustoconical shape; Element 15: wherein the vent extends at least partially through the binder bowl (when provided for); and Element 16: wherein infiltrating the matrix material with the liquefied binder material comprises: flowing the liquefied binder material through the at least one passageway (when provided for) and into the annular space; and preventing the liquefied binder material from entering an interior space of the vent.

By way of non-limiting example, exemplary combinations applicable to embodiments A and B may include: Element 12 in combination with Element 10 and optionally Element 11; Element 13 in combination with Element 10 and optionally Element 11; Element 14 in combination with Element 10 and optionally Element 11; Element 13 in combination with Element 14; Element 15 and/or 16 in combination with any of the foregoing (where a binder bowl is provided for); Element 15 and/or 16 in combination with at least one of Elements 10-14 (where a binder bowl is provided for); Elements 15 and 16 in combination (where a binder bowl is provided for); Element 8 and optionally Element 9 in combination with any of the foregoing; Element 8 and optionally Element 9 in combination with at least one of Elements 10-16; and Element 8 and Element 9 in combination.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A mold assembly comprising:
a cavity defined within the mold assembly;
a core disposed within the cavity;
a matrix material disposed within the cavity;
a metal blank disposed about the core and supported at least partially by the matrix material such that the metal blank extends above the matrix material;
a vent extending from the metal blank and thereby defining an annular space between the vent and the mold assembly; and
a binder bowl coupled to the mold assembly and comprising at least one passageway being radially spaced apart from a central axis of the mold assembly and disposed above the annular space.

2. The mold assembly of claim 1, wherein the vent is coupled to the metal blank.

3. The mold assembly of claim 1, wherein the vent extends at least partially through the binder bowl.

4. The mold assembly of claim 1 further comprising:
a tubing coupled to and extending from the vent, wherein the tubing is operably connected to a low pressure source.

5. The mold assembly of claim 1 further comprising:
a tubing coupled to the annular space.

6. The mold assembly of claim 1, wherein the vent is fluidly coupled to the annular space only through interstitial spaces of the matrix material.

7. The mold assembly of claim 1, wherein the vent is frustoconical in shape.

8. The mold assembly of claim 1, wherein the vent defines an interior space that extends along the central axis, the at least one passageway being positioned outside of the interior space.

9. The mold assembly of claim 8, wherein the at least one passageway comprises two passageways positioned outside of the interior space, the interior space having a diameter that is larger than an outside diameter of the core.

10. A method comprising:
assembling a mold assembly that comprises:
a cavity defined within the mold assembly;
a core disposed within the cavity;
a matrix material disposed within the cavity;
a metal blank disposed about the core and supported at least partially by the matrix material such that the metal blank extends above the matrix material; and
a vent extending from the metal blank and thereby defining an annular space between the vent and the mold assembly;
placing a binder material in the annular space;
liquefying the binder material; and
infiltrating the matrix material with the liquefied binder material to displace air from interstitial spaces of the matrix material to the vent, wherein the liquefied binder flows from the annular space toward the matrix material disposed between the core and the metal blank.

11. The method of claim 10 further comprising:
coupling a tubing to the vent, the tubing being in fluid communication with a low pressure source; and
reducing an air pressure within an interior space of the vent via the tubing.

12. The method of claim 10 further comprising:
coupling a tubing to the annular space, the tubing being in fluid communication with a high pressure source; and
increasing an air pressure within the annular space via the tubing.

13. The method of claim 10 further comprising fluidly coupling the vent with the annular space only through the interstitial spaces of the matrix material.

14. The method of claim 10, wherein the vent has a frustoconical shape.

15. A method comprising:
assembling a mold assembly that comprises:
a cavity defined within the mold assembly;
a core disposed within the cavity;

matrix material disposed within the cavity;

a metal blank disposed about the core and supported at least partially by the matrix material such that the metal blank extends above the matrix material;

a vent extending from the metal blank and thereby defining an annular space between the vent and the mold assembly; and a binder bowl coupled to the mold assembly and comprising at least one passageway being radially spaced apart from a central axis of the mold assembly and disposed above the annular space;

placing a binder material in the binder bowl;

liquefying the binder material; and infiltrating the matrix material with the liquefied binder material to displace air from interstitial spaces of the matrix material to the vent.

16. The method of claim 15, wherein the vent extends at least partially through the binder bowl.

17. The method of claim 15 further comprising:

coupling a tubing to the vent, the tubing being in fluid communication with a low pressure source; and reducing an air pressure within an interior space of the vent via the tubing.

18. The method of claim 15 further comprising:

coupling a tubing to the annular space, the tubing being in fluid communication with a high pressure source; and increasing an air pressure within the annular space via the tubing.

19. The method of claim 15 further comprising fluidly coupling the vent with the annular space only through the interstitial spaces of the matrix material.

20. The method of claim 15, wherein infiltrating the matrix material with the liquefied binder material comprises:

flowing the liquefied binder material through the at least one passageway and into the annular space; and preventing the liquefied binder material from entering an interior space of the vent.

* * * * *